US007472665B2

(12) United States Patent
Bertin

(10) Patent No.: US 7,472,665 B2
(45) Date of Patent: Jan. 6, 2009

(54) LINEAR-MOTOR APPARATUS FOR MOVING SENSOR-SUPPORT TUBES OF SUBMARINES

(75) Inventor: Daniele Maria Bertin, Calderara Di Reno (IT)

(73) Assignee: Calzoni S.r.l., Calderara Di Reno (Bologna) (IT)

( * ) Notice: Subject to any disclaimer, the term of this patent is extended or adjusted under 35 U.S.C. 154(b) by 0 days.

(21) Appl. No.: 11/426,732

(22) Filed: Jun. 27, 2006

(65) Prior Publication Data

US 2007/0068441 A1 Mar. 29, 2007

(30) Foreign Application Priority Data

Jun. 28, 2005 (IT) ..... MI2005A1220

(51) Int. Cl.
*B63G 8/04* (2006.01)

(52) U.S. Cl. ..... 114/339; 114/340

(58) Field of Classification Search ..... 114/339, 114/340, 312

See application file for complete search history.

(56) References Cited

U.S. PATENT DOCUMENTS

| | | | | | |
|---|---|---|---|---|---|
| 4,402,386 | A * | 9/1983 | Ficheux et al. | ..... | 187/289 |
| 4,714,400 | A * | 12/1987 | Barnett et al. | ..... | 414/751.1 |
| 5,128,688 | A * | 7/1992 | West | ..... | 343/766 |
| 5,235,226 | A * | 8/1993 | Olsen et al. | ..... | 310/12 |
| 5,634,424 | A * | 6/1997 | Ortelli | ..... | 114/339 |
| 6,330,837 | B1 * | 12/2001 | Charles et al. | ..... | 74/490.06 |
| 6,715,439 | B1 * | 4/2004 | Ortelli | ..... | 114/339 |

FOREIGN PATENT DOCUMENTS

| | | |
|---|---|---|
| FR | 2 271 428 A | 12/1975 |
| GB | 1 464 056 A | 2/1977 |
| GB | 1 507 076 A | 4/1978 |
| GB | 2 196 581 A | 5/1988 |

* cited by examiner

*Primary Examiner*—Sherman Basinger
(74) *Attorney, Agent, or Firm*—Timothy J. Klima

(57) ABSTRACT

Apparatus for moving tubes (10) which are displaceable upon operation of an actuator (40) inside fixed guides (20) integral with the tower (1*a*) of submarines (1) and the like, said actuator (40) consisting of at least one pair of linear motors (41).

18 Claims, 1 Drawing Sheet

Fig. 1
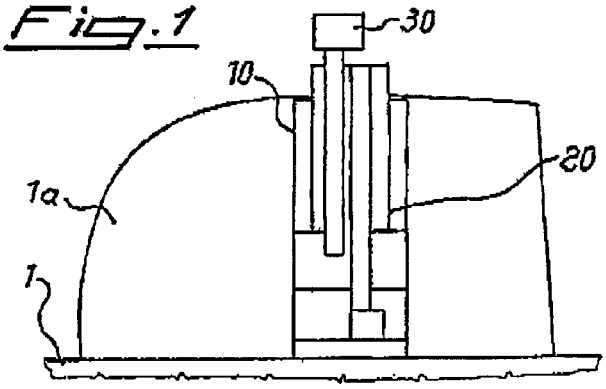
Fig. 2
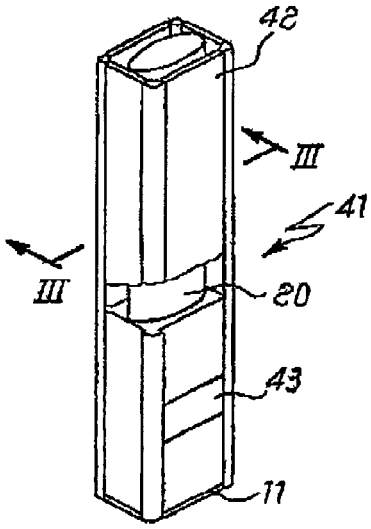
Fig. 3
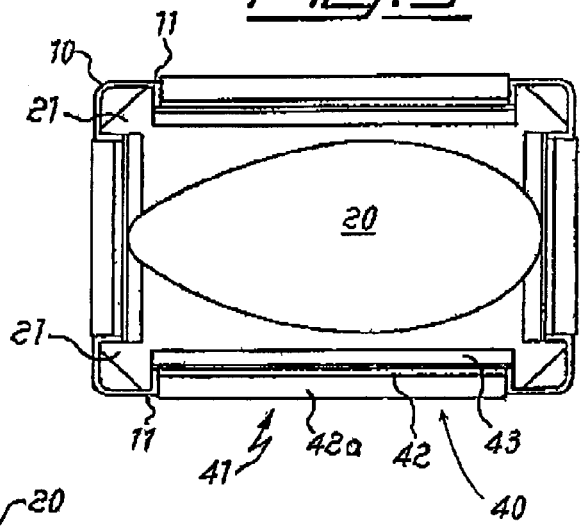
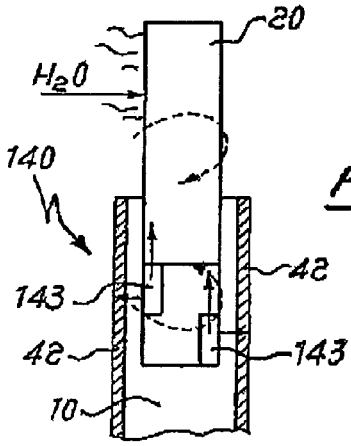
Fig. 4

LINEAR-MOTOR APPARATUS FOR MOVING SENSOR-SUPPORT TUBES OF SUBMARINES

CROSS REFERENCE TO RELATED APPLICATIONS

Italian Patent Application No. MI2005A 001220 which is hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to an apparatus for moving tubular parts of submarines, which comprises actuating elements or means comprising at least one pair of linear motors.

2. Description of Related Art

It is known in the technical sector relating to submarines that there exists the need to raise outside the water, when the submarine is at periscope height, a certain number of sensors of the passive and active type such as radar and/or radio antennas, optronic heads and the like which are normally housed inside the tower (or sail) of the submarine and, when required, are displaced vertically by suitable hydraulic raising devices until they emerge outside the free surface of the water situated above the tower.

It is also known that these vertical displacement apparatus must: operate in a particularly silent manner in order to avoid identification by means of acoustic sensors; be able to withstand the underwater pressure which is produced at the navigation depth of the submarine; and resist corrosion by the seawater and be able to raise the sensor support tube, overcoming not only the weight thereof, but also the friction produced by the hydrodynamic thrust of the water, owing to the movement of the submarine, on the tube sliding guides said transverse thrust being mainly responsible for the overall resistance to displacement in the vertical direction.

For this purpose, in the art apparatus which envisage the use of oil-operated actuating systems are known, these, however, requiring a hydraulic system comprising among other things a pumping station with consequent constructional complications and an increase in the need for maintenance in order to prevent the oil from being contaminated by water infiltration.

BRIEF SUMMARY OF THE INVENTION

The technical problem which is posed, therefore, is that of providing an apparatus for raising sensor support tubes of submarines which is particularly silent, corrosion-resistant, compact, able to be produced and assembled in an easy and low-cost manner and easily installed on any ship or submarine with a small number of operations performed in situ.

These results are achieved according to the present invention by an apparatus for moving tubes which are displaceable, upon operation of an actuator, in fixed guides integral with the tower of submarines, ships, and the like, said actuator consisting of at least one pair of linear motors.

BRIEF DESCRIPTION OF THE SEVERAL VIEWS OF THE DRAWINGS

Further details may be obtained from the following description of a non-limiting example of embodiment of the object of the present invention provided with reference to the accompanying drawings in which:

FIG. 1 shows a schematic cross-section along a vertical plane of the tower of a submarine with associated tube housed inside the sliding guide;

FIG. 2 shows a partial perspective view of the guide according to the present invention;

FIG. 3 shows a cross-section along the plane indicated by III-III in FIG. 2;

FIG. 4 shows a schematic cross-section along a vertical plane of a variation of an example of embodiment according to the invention.

DETAILED DESCRIPTION OF THE INVENTION

As shown in FIG. 1, the conventional apparatus comprises a fixed guide 10 inside which a tube 20 carrying the sensors 30 moves in the longitudinal direction and is actuated by means of an actuator 40.

According to the invention (FIG. 2), it is envisaged that said actuator 40 consists of a linear electric motor 41 which in a preferred embodiment comprises a surface 42 made of conductive material and preferably realized in the form of a flat plate extending over a suitable length of the guide 10 in the longitudinal direction and mounted on at least one pair of facing walls 11 of the said guide.

It is envisaged moreover that, if the thickness of the sheet 42 should require it, the said sheet is fixed to a surface 42*a* acting as a support and a screen for the magnetic flux 1. The actuator 40 envisages, moreover, a moving part 43 integral with the tube 20 and consisting of a suitable set of electrical windings suitably covered in a conventional manner with insulating and protective resins.

In a second embodiment (not shown), it is envisaged that the linear motor may also be of the variable-reluctance type.

In this case, the fixed part of the motor, integral with the guide, is made of ferromagnetic material, instead of conductive material.

Although described with a fixed and movable component arranged along a single pair of opposite sides of the fixed guide 10 and the tube 20, it is envisaged that a similar structure may be realized on the other pair of opposite sides of the said guide and tube, obtaining in this way two complementary motors able to increase the overall force exerted on the tube for movement thereof.

FIG. 4 shows a variation of embodiment of the apparatus according to the invention in which the plates 143 integral with the moving tube 20 and containing the windings are arranged asymmetrically in the longitudinal direction of movement of the said tube.

With such an arrangement it is possible to obtain a further result consisting in the fact that the force of magnetic attraction which is produced between the winding 143, integral with the tube 20, and fixed part 42, integral with the guide 10, exerts forces in the opposite direction to those produced by the hydrodynamic thrust of the water on the slides 21 of the tube 20 when the submarine is moving.

This results in a reduction in the component (friction) resisting the sliding movement of the tube, said reduction allowing a more effective dimensional design of the entire assembly.

It is therefore clear how the apparatus for moving the sensor support tubes of submarines according to the invention is particularly silent, not having mechanical moving parts and being particularly resistant to corrosion without substantial additional costs since the windings of the linear motor are already protected by a suitable insulating resin and the fixed metal part may be formed by the walls of the guide, which must in any case be corrosion-resistant.

In addition to this, the particular large contact surface area of the components of the motor with the surrounding water results in a considerable improvement in cooling of the said motor, overcoming the corresponding intrinsic defect (overheating) of possible solutions which have motors arranged inside closed containers.

With the apparatus it is possible to obtain, moreover, a further advantage consisting in the fact that, since the actuator for moving the tube 20 is partly integrated inside the tube and partly inside the guide, the entire assembly process may be performed at the production plant and the pre-assembled unit may be installed on the submarine using the so-called "cartridge" technique, with obvious advantages in terms of precision, simplicity and cost savings.

The invention claimed is:

1. An apparatus for moving a tube which is displaceable with respect to a tower of a submarine, comprising:

an actuator, a fixed guide positioned within the tower for axially movably supporting the tube, the actuator operably connected between the fixed guide and the tube for axially moving the tube, the actuator including a pair of linear electric motors, each of which has a fixed component and a movable component arranged along a single pair of opposing sides of the fixed guide and the tube, respectively;

wherein the movable component of each linear electric motor comprises windings integral with the movable tube and the fixed component of each linear electric motor is integral with the fixed guide and forms a structural wall of the fixed guide.

2. The apparatus according to claim 1, wherein the fixed component of each linear electric motor is in the form of a flat plate.

3. The apparatus according to claim 2, and further comprising a sheet of suitable thickness joined to the flat plate, the sheet acting as a support and a screen against magnetic flux.

4. The apparatus according to claim 1, wherein at least one of the linear motors is asynchronous.

5. The apparatus according to claim 4, wherein the fixed component of at least one of the linear motors is made of conductive material.

6. The apparatus according to claim 1, wherein at least one of the linear motors is a variable-reluctance motor.

7. The apparatus according to claim 6, wherein the fixed component of at least one of the linear motors is made of ferromagnetic material.

8. The apparatus according to claim 1, wherein the linear motors comprise windings arranged asymmetrically along a longitudinal direction of movement of the tube to produce a torque from forces of attraction between the fixed components and the movable components of the linear motors.

9. An apparatus for moving a tube which is displaceable with respect to a tower of a submarine, comprising:

an actuator, coupled to the tube, at least one fixed guide positioned within the tower of the submarine for axially movably supporting the tube, wherein said actuator is operably connected between the fixed guide and the tube for axially moving the tube and includes at least one pair of linear electric motors, each linear motor having a fixed and movable component arranged along a single pair of opposite sides of the fixed guide and the tube, respectively;

wherein the movable component of each linear electric motor comprises windings integral with the movable tube and the fixed component of each linear electric motor is integral with the fixed guide and forms a structural wall of the fixed guide.

10. An apparatus for moving a tube which is displaceable with respect to a tower of a submarine, comprising:

a fixed guide positioned with the tower, an actuator positioned inside the fixed guide and including a pair of linear motors, wherein the linear motors comprise windings arranged asymmetrically along a longitudinal direction of movement of the tube to produce a torque from forces of attraction between fixed components and movable components of the linear motors.

11. The apparatus according to claim 10, wherein at least one of the linear motors comprises windings integral with the movable tube.

12. The apparatus according to claim 10, wherein the fixed component of at least one of the linear motors is integral with the fixed guide.

13. The apparatus according to claim 12, wherein the fixed component of the at least one linear motor is in the form of a flat plate which is integral with walls of the fixed guide.

14. The apparatus according to claim 13, and further comprising a sheet of suitable thickness joined to the flat plate, the sheet acting as a support and a screen against magnetic flux.

15. The apparatus according to claim 10, wherein at least one of the linear motors is asynchronous.

16. The apparatus according to claim 15, wherein the fixed component of at least one of the linear motors is made of conductive material.

17. The apparatus according to claim 10, wherein at least one of the linear motors is a variable-reluctance motor.

18. The apparatus according to claim 17, wherein the fixed component of at least one of the linear motors is made of ferromagnetic material.

* * * * *